US005383781A

United States Patent [19]

Stouffer

[11] Patent Number: 5,383,781

[45] Date of Patent: * Jan. 24, 1995

[54] BURNER METHOD AND APPARATUS

[75] Inventor: Ronald D. Stouffer, Silver Spring, Md.

[73] Assignee: Bowles Fluidics Corporation, Columbia, Md.

[ * ] Notice: The portion of the term of this patent subsequent to Sep. 22, 2009 has been disclaimed.

[21] Appl. No.: 50,385

[22] PCT Filed: Jun. 4, 1992

[86] PCT No.: PCT/US92/04446

§ 371 Date: May 12, 1993

§ 102(e) Date: May 12, 1993

[87] PCT Pub. No.: WO92/22735

PCT Pub. Date: Dec. 23, 1992

[51] Int. Cl.[6] ..... F23D 11/00

[52] U.S. Cl. ..... 431/2; 431/1; 431/344; 239/11; 239/589.1

[58] Field of Search ..... 431/344, 8, 252, 127, 431/350, 354, 353, 1, 2, 91, 160; 239/589.1, 11, 310, 727, 101; 137/835, 820

[56] References Cited

U.S. PATENT DOCUMENTS

| | | | |
|---|---|---|---|
| 2,601,893 | 7/1952 | Funke | 431/91 |
| 3,759,245 | 9/1973 | Greco, Jr. | 431/344 X |
| 4,052,002 | 10/1947 | Stouffer et al. | 137/835 X |
| 4,395,227 | 7/1983 | Stivers | 431/344 X |
| 4,508,267 | 4/1985 | Stouffer | 137/835 X |
| 4,720,259 | 1/1988 | Day | 431/344 X |
| 4,952,138 | 8/1990 | Ho | 431/344 X |
| 4,955,547 | 9/1990 | Woods | 137/835 X |
| 5,149,263 | 9/1992 | Stouffer | 431/2 |

*Primary Examiner*—Larry Jones

*Attorney, Agent, or Firm*—Jim Zegeer

[57] ABSTRACT

A burner or torch system for mixing fuel with air and includes a fluid oscillator for forming a jet or sheet of fuel and oscillating the jet in ambient air downstream of the fluid oscillator. This mixes air with fuel and achieves a combustible mixture a distance spaced from any physical structure of the burner or torch whereby a flame front of burning combustible mixture has a shape and distance from the fluid oscillator which is determined by the sweep angle, wave pattern and frequency of the fluid oscillator. Various forms of fluidic oscillators are disclosed.

17 Claims, 5 Drawing Sheets

FIG. 1a
PRIOR ART
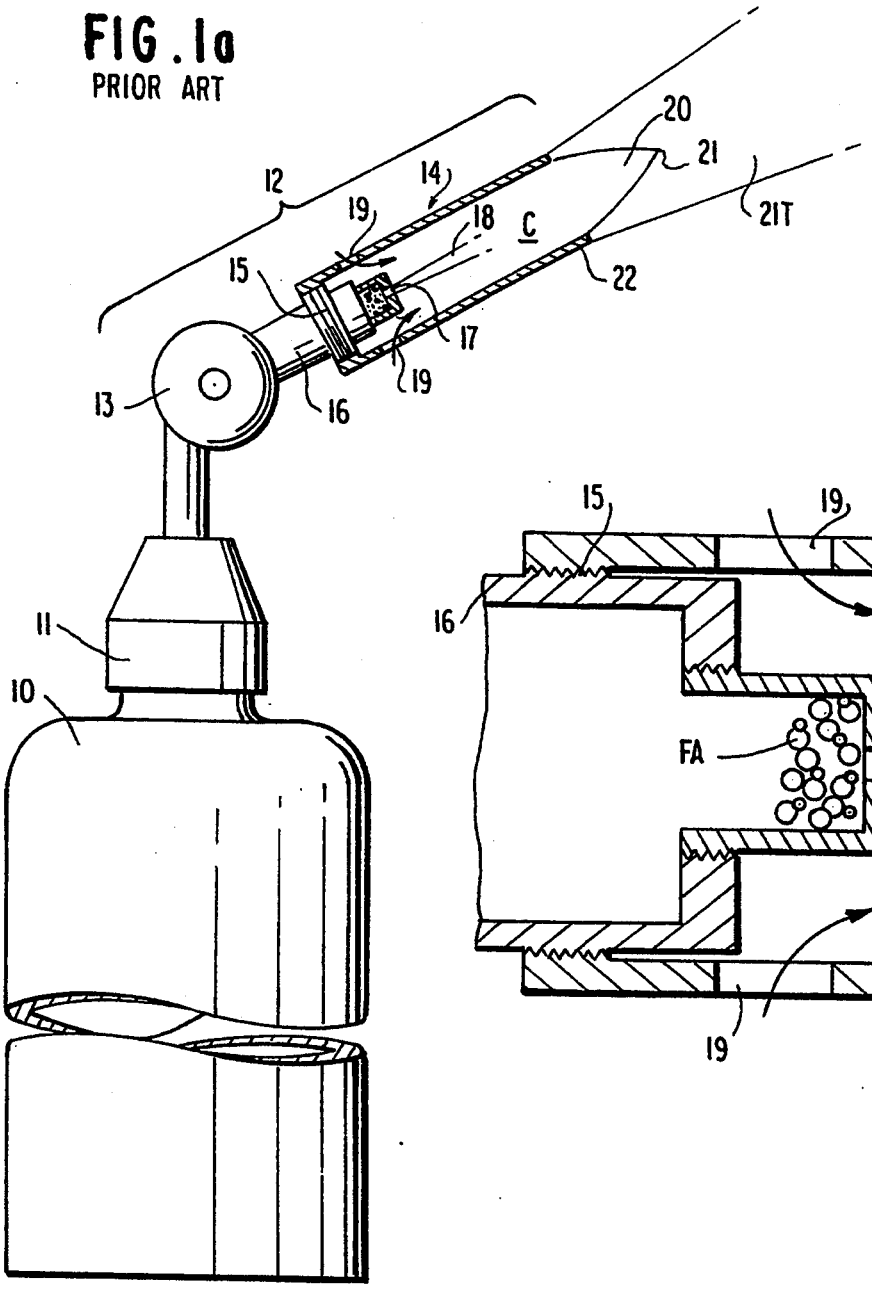
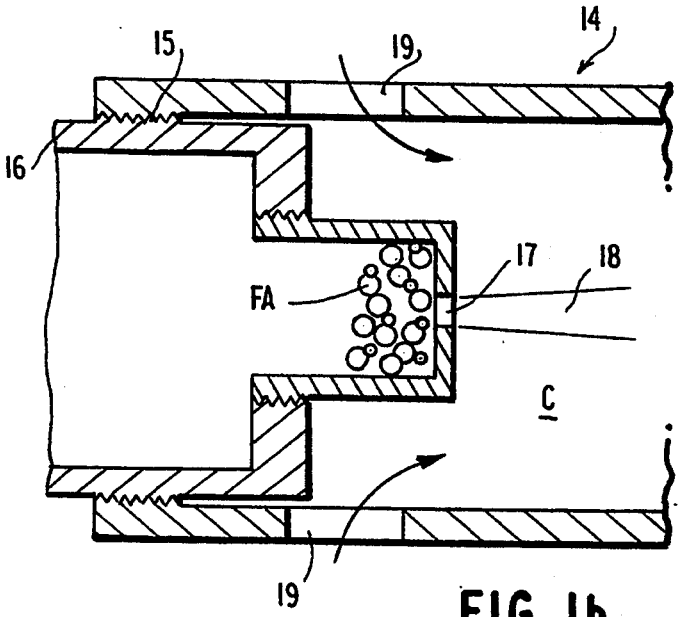
FIG. 1b
PRIOR ART
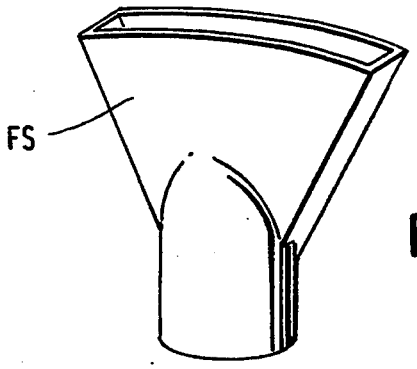
FIG. 1c
PRIOR ART FIG. 2
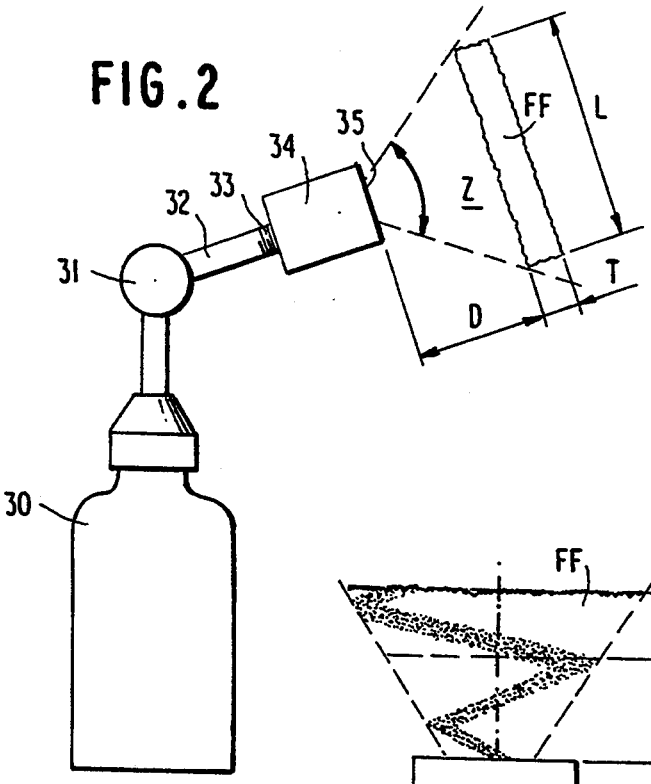
FIG. 3a
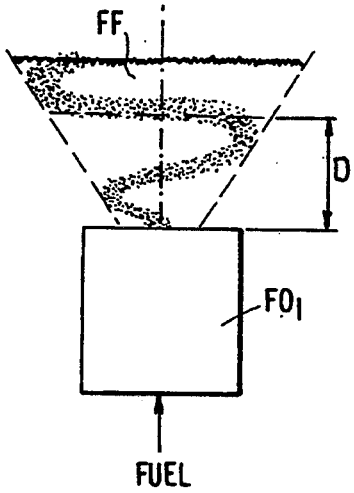
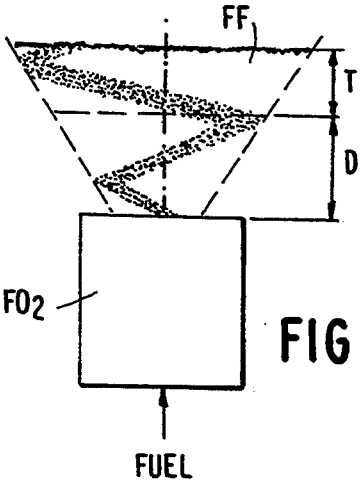
FIG. 3b
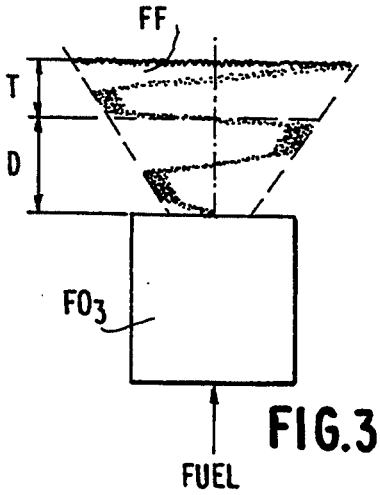
FIG. 3c
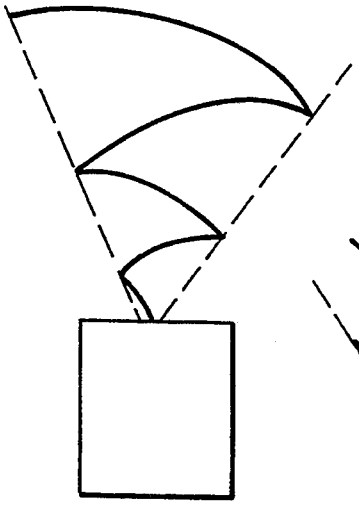
FIG. 3d
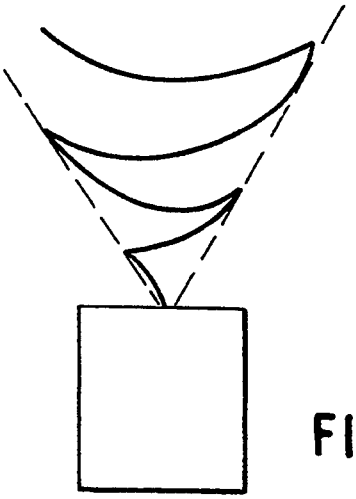
FIG. 3e

BURNER METHOD AND APPARATUS

BACKGROUND AND BRIEF DESCRIPTION OF THE INVENTION

The present invention relates to burner method and apparatus wherein fuels such as gas must have a stoichiometric air/fuel mixture for purposes of combustion to achieve the most efficient flame characteristics.

In conventional propane gas torches, for example, the burner nozzle has a chamber for mixing stoichiometric ratio to achieve a blue flame which has a point of highest temperature to be the most efficient use of fuel. Heating of an object having a large surface area requires passing the torch flame tip back and forth over the area or using a diffusing nozzle to heat it somewhat uniformly.

According to the present invention, a fluidic oscillator incorporated in the burner nozzle sweeps the jet of fuel, which may be somewhat internally mixed with air inside the mixing chamber but most or all of the mixing with air is achieved outside of and downstream of the nozzle and within a predetermined distance. The swept jet fuel mixes with air in the space between the outlet opening so that upon combustion it produces a flame front having an area and thickness determined by the sweep angle and wave pattern of the fluidic oscillator and the rate of mixing proportional to frequency of oscillation is self-regulating to achieve a proper fuel-air ratio needed for combustion. A wide variety of fluidic oscillators are known and useful in practicing of the invention.

Advantages of the invention are that the shape of the hot flame front is expanded and spaced from the physical burner nozzle to achieve a high heat transfer efficiency while at the same time, the physical nozzle remains cool and thus in some applications can be made of plastic. Moreover, by providing oscillators with different frequency of oscillation, and wave patterns, the distance of the flame front and the shape thereof can be adjusted to accommodate different use services or applications.

Almost any fluidic oscillator in which the fuel can be formed into an oscillatable or sweepable jet e.g., a jet that is oscillatable that is sufficient to achieve proper mixing of fuel to be combustible a predetermined distance from the nozzle can be used. Such devices are shown in U.S. Pat. No. 4,052,002 for controlled fluid dispersal techniques, Bray U.S. Pat. Nos. 4,463,904 and 4,645,126, Stouffer U.S. Pat. No. 4,508,267 and Stouffer and Bauer U.S. Pat. No. Re. 33,158 are useful. In the preferred embodiment, it is desired to achieve as much external mixing of the fuel with air as is possible to have as large a detached flame front as possible. In some cases however, fluidic oscillators having diverging outlets sweep the fuel jet back and forth and entrain some air into the nozzle and hence these are likewise useful but do not have as large a spacing between the flame front and the nozzle because there is less efficient external mixing of fuel with air to achieve the stoichiometric ratio.

DESCRIPTION OF THE DRAWINGS

The above and other objects, advantages and features of the invention will become more apparent when considered with the following specification and accompanying drawings wherein:

FIG. 1*a* is a diagrammatic perspective view of a conventional prior art propane torch, FIG. 1*b* is an enlarged view of the nozzle, and FIG. 1*c* is a flame spreader, FIG. 2 is a generalized diagrammatic illustration of a propane torch and nozzle incorporating the invention showing the sweeping jet and the detachment of the flame front with the distance between the flame front and the nozzle forming a mixing area for achieving the stoichiometric gas/air mixture for proper combustion, FIGS. 3*a, b, c, d,* and *e* are diagrammatic illustrations of various fluidic oscillators which are useful in practicing the invention.

DETAILED DESCRIPTION OF THE INVENTION

Figure 4A:
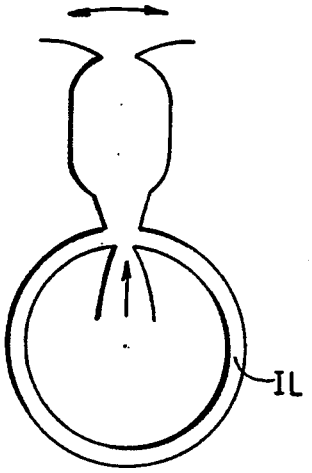
FIG.4a PRIOR ART
FIGS. 4*a*–4*f* are diagrammatic illustrations of various prior art fluidic oscillator silhouettes useful in practicing the invention.

The conventional propane torch is illustrated in FIG. 1 being mounted on a FUEL tank 10 through a conventional threaded fitment 11 securing the torch 12 to tank 10. It will be appreciated that flexible tubing, pressure gauges, regulators and like arrangements may be likewise utilized. A valve 13 controls the flow of fuel (propane in this embodiment) from propane tank 10 to the torch nozzle proper 14. Torch nozzle proper 14 is threadably secured to the threaded end 15 of pipe 16. An aperture or orifice 17 (typically about 0.003" in diameter) issues a jet of propane fuel into a chamber 18 which is provided with a series of openings 19 through Which air is entrained by the flow of jet 18 into chamber C. By adjusting the valve 13, the proper air/fuel ratio is achieved so that a well defined blue flame 20 having a tip 21 with a trailing transparent blue flame portion 21T is achieved. The spacing of the flame front 20 from the nozzle end 22 is in most cases nonexistent. Thus, the nozzle 14 typically will heat up.

Most importantly however is that the flame front 20 is elongated into a tip having a typical "flame" shape with which the hot spot is around approximate the tip 21. A flame diffuser or spreader FS (FIG. 1*c*) can be attached to the end of the chamber C to broaden the flame. The device shown in FIG. 1 includes a conventional safety devices such as a flame arrester FA such that when the fuel pressure drops to such a low level that it is not able to project beyond the confines of the device, the flame does not spread back to ignite fuel in the tank.

There are numerous other prior art systems, in some of which air is entrained through an opening in pipe 16, for example, and premixed with air so that in the torch chamber C itself, less air is required to be entrained to achieve a proper fuel-air ratio to support combustion.

Referring now to FIG. 2, a fuel tank such as a propane tank 30 and valve 31 has tube or pipe 32 (which is identical to tube or pipe 16 and also may include the conventional premix entrainment orifices and the like as well as the safety devices described above) is fitted on its threaded end 33 with a fluidic oscillator nozzle 34 which produces a jet of fuel which is swept through an angle ($\alpha$) in a mixing zone Z to support a combustion flame front FF which is spaced a distance D from the end 35 of fluidic oscillator nozzle 34. This distance D and the shape of the flame front FF are significant improvements achieved by the present invention. Sweeping the jet stream of fuel through the angle ($\alpha$) and at a predetermined rate (for example, about 1 to 3 kHz) results in an efficient mixing with air to achieve the proper fuel-air mixture at a distance D downstream of the nozzle so as that the nozzle itself will remain cool and the flame front FF can be shaped to be a broad hot flame front. Thus, instead of having to oscillate the nozzle back and forth to heat-up a broad surface area, the nozzle is held stationary and the flame front is shaped to have a length L and the thickness T. Thus, in comparison to the flame front for the conventional torch, the present invention provides a broad area flame front which is significantly spaced from the nozzle so that the nozzle remains essentially cool (radiant heat reflected from a heated object, of course can heat the nozzle) but is counteracted by cool, expanding fuel making the nozzle more efficient (because inter alia the heat from the torch itself is supplied to the object rather than to heating-up the nozzle).

FIGS. 3*a*, 3*b* and 3*c* diagrammatically illustrate the sweeping output from fluidic oscillators FO1, FO2 and FO3. In the oscillator FO1, the end FIG. 3*a*, the oscillator is designed to provide a sinusoidal sweep of the fuel, and if a stop motion strobe is projected on the output stream, the waveform is essentially a sinusoidal shape. In the fluidic oscillator of FIG. 3*b*, the fluidic oscillator FO2 has a triangular-shaped output and in FIG. 3*c*, fluidic oscillator FO3 has a traposoidal output. That is, there is a dwell resulting in more fuel being mixed with air at its proper fuel-air ratio at the lateral ends of each sweep than in the middle and resulting in a larger flame at those points.

When the fuel rate increases, the velocity of the sweep increases proportionately but the wavelength remains constant and the mixing goes with the frequency, double the frequency, double the mixing rate which means that the proper fuel-air ratio is arrived at a distance closer to the output edges 35. Thus, the shape of the flame front can be adjusted to accommodate targets and effect a higher heat transfer efficiency while maintaining a relatively cool nozzle. In some cases, the nozzle can be made out of plastic, particularly in those situations where radiant heat from the object being heated is low.

Figure 4B:
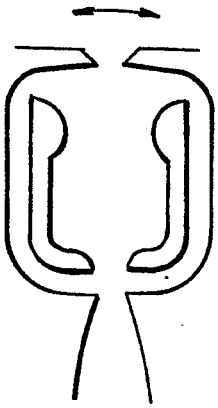
FIG.4b PRIOR ART
Figure 4C:
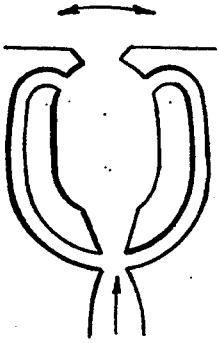
FIG.4c PRIOR ART
Figure 4D:
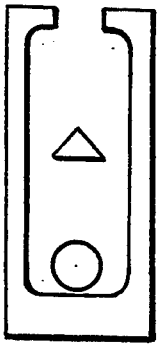
FIG.4d PRIOR ART
Figure 4E:
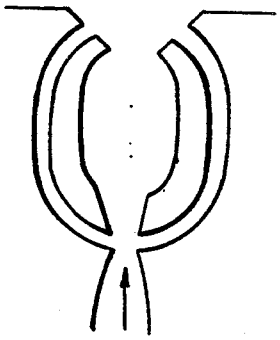
FIG.4e PRIOR ART

In FIGS. 4*a*, 4*b*, 4*c*, 4*d*, 4*e* and 4*f*, there are disclosed various oscillator configurations useful in practicing the invention. In FIG. 4*a*, the oscillator is of the type disclosed in U.S. Pat. No. Re. 33,158 of Stouffer and Bauer entitled "FLUIDIC OSCILLATOR WITH RESONANT INERTANCE AND DYNAMIC COMPLIANCE CIRCUIT" and utilizes an inertance loop IL for oscillation. FIG. 4*b* discloses a fluidic oscillator of the type disclosed in Stouffer U.S. Pat. No. 4,508,267 and depends on the formation and movement of vortices in the chamber to sustain oscillations. FIG. 4*c* discloses an oscillator of the type disclosed in Bray U.S. Pat. No. 4,463,904. The oscillator shown in FIG. 4*d* is an island oscillator of the type disclosed in Stouffer U.S. Pat. No. 4,151,955. In FIG. 4*e*, the oscillator is of the type disclosed in Stouffer and Bray U.S. Pat. No. 4,052,002. In each of these instances, the fluidic oscillator is of the type in which there is a single outlet and the fuel exiting through the outlet of the device seals the oscillator chamber from ambient conditions. In the oscillator shown in FIG. 4*e*, the internal pressure of the device is greater than ambient so that there is always an outflow of fluid.

Figure 4F:
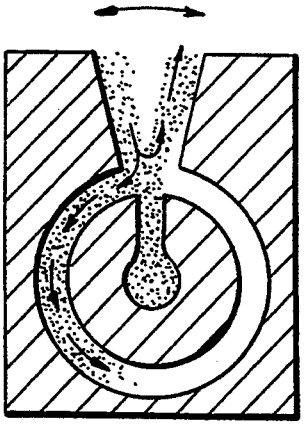
FIG.4f PRIOR ART

In FIG. 4*f*, the oscillator is of the type disclosed in the Encyclopedia of Science and Technology (Von Nostrand). In this oscillator type, there is entrainment of ambient air which serves to premix the fuel with air with the fully combustible mixture being arrived through sweeping the fuel jet and at a distance spaced downstream of the edges of the oscillator. This is a less preferred embodiment of the invention because of its dependence on ambient air being drawn into the device itself somewhat in the fashion of the prior art nozzle discussed above. Moreover, because of this entrainment of ambient air, the flame front is spaced closer to the edge of the nozzle and the shape of the frame front is less well controllable. These prior art references are incorporated herein by reference and disclose the operating regimes thereof.

Operation of all fluidic oscillators is characterized by the cyclical deflection of the fuel jet without use of mechanical means of moving parts and consequently, the oscillators are not subject to wear and tear which adversely affects reliability and operation thereof. Moreover, since only the jet and not the entire orifice bearing body is translated, less energy is required to achieve jet oscillation. See Stouffer and Bray U.S. Pat. No. 4,052,002.

Various means can be utilized for varying the frequency of oscillation. For example, in the oscillator shown in FIG. 4*a*, by varying the length of the inertance IL, the frequency can be adjusted.

Figure 5:
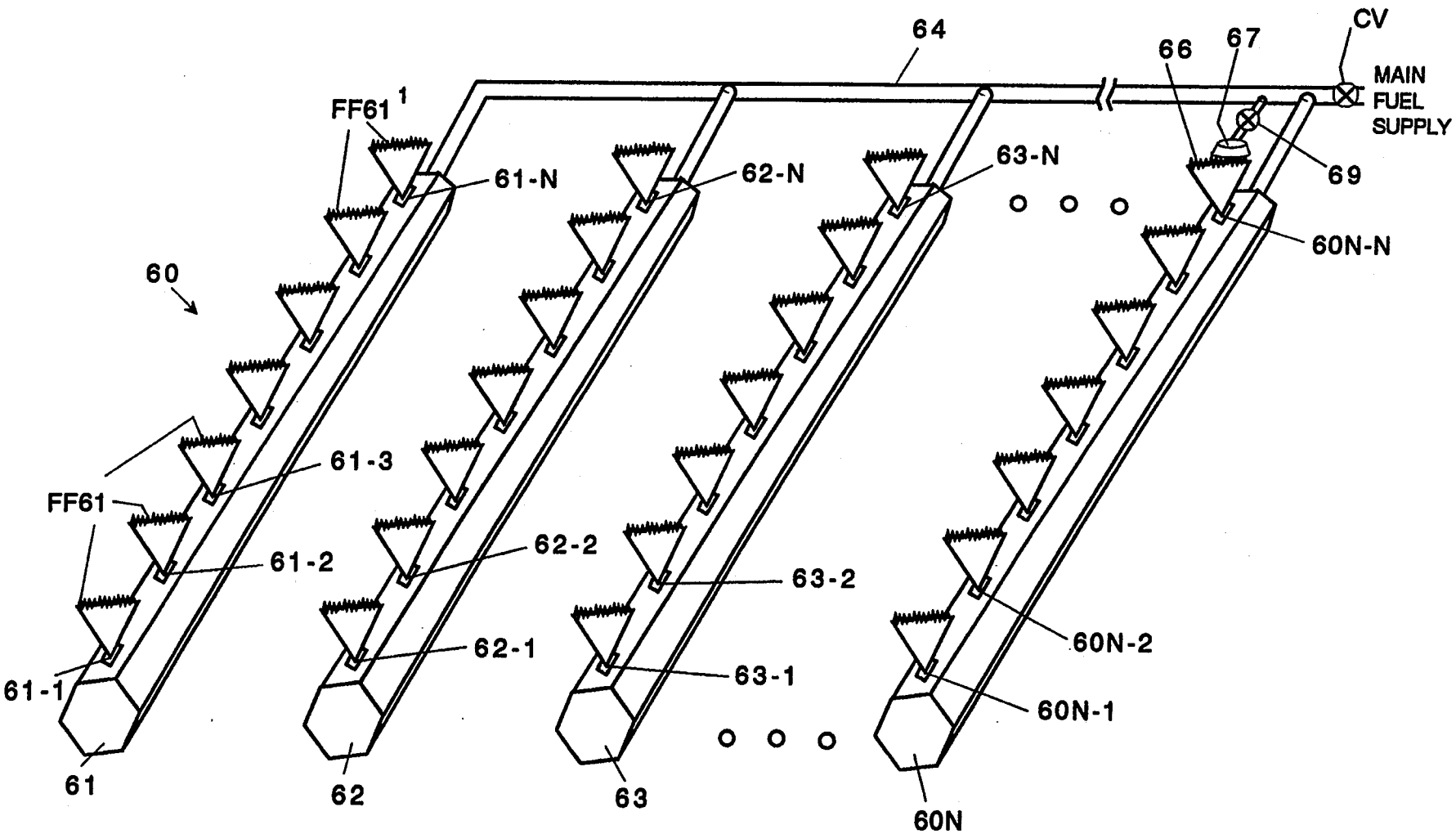
FIG. 5 is a diagrammatic illustration of a furnace burner wherein a plurality of fluidic burner nozzles are arrayed in one or more lines and coupled to one or more fuel manifold.

In the embodiment shown in FIG. 5, one or more arrays 60 of diagrammatically indicated fluidic oscillators 61-1, 61-2 . . . 61-N, 62-1, 62-2 . . . 62-N, 60N-1, 60N-2, 60N-N on one or more gas fuel manifolds 61, 62, 63 . . . 60N are supplied from a main supply 64 through control valve CV. A pilot flame 96 is supplied with fuel by nozzle 67 which is valved at 69. Any of the types of fluidic oscillator nozzles disclosed herein may be used to oscillate the fuel stream in ambient air to achieve a proper fuel air mixture for the most efficient combustion. In FIG. 5, the broad shaped flame fronts FF61 are spaced from the oscillating nozzles a predetermined distance determined by the sweep angle; wave pattern and frequency of the fluidic oscillators 61-1, 61-2 . . . 60N-1 . . . 60N-N.

Figure 7:
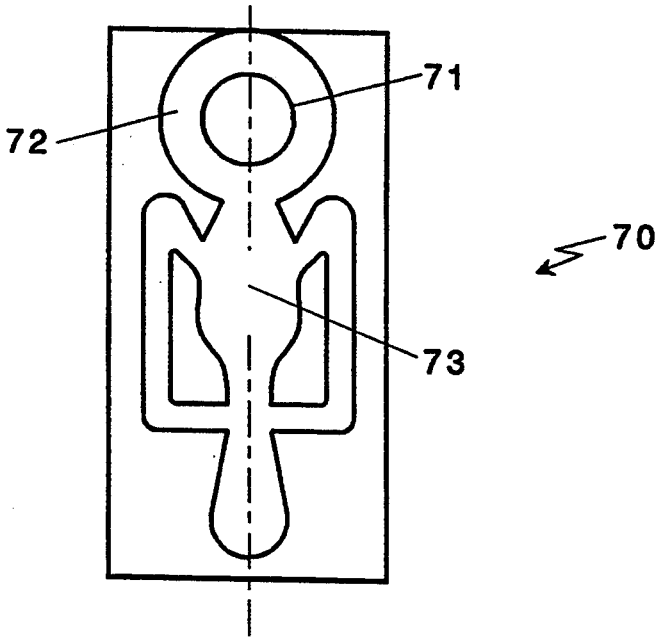
FIG. 7 is a diagrammatic illustration of a fluidic oscillation of the type shown in Stouffer U.S. Pat. No. 4,151,955 for issuing a jet in the form of a sheet of fuel which is oscillated to achieve a combustible air-fuel mixture.

If the oscillators are of the type which issues a sheet of fluid fuel which is oscillated as described above, then the broad flame front will have a significantly larger area. The oscillator silhouette 70 shown in FIG. 7 is the type shown in the aforementioned Bray patents (but without taper) and is provided with a circular island 71 as shown in FIG. 20 of Stouffer U.S. Pat. No. 4,151,955. In this case the island 71 has been positioned out of the oscillator interaction region 73 to a generally circular outlet region 72 and produces a swept sheet which is issued to ambient.

Figure 6A:
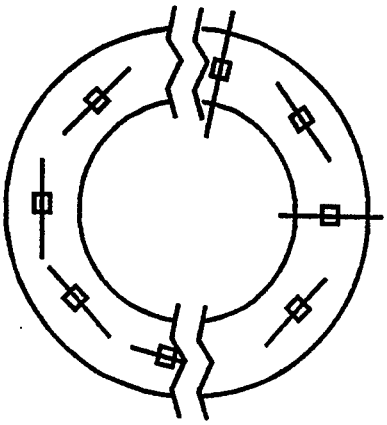
FIGS. 6*a* and 6*b* are diagrammatic illustrations of stove top burners ;wherein a plurality of fluidic burner nozzles are arrayed in a predetermined pattern such as a circle, or crossed and coupled to a common fuel manifold.
Figure 6B:
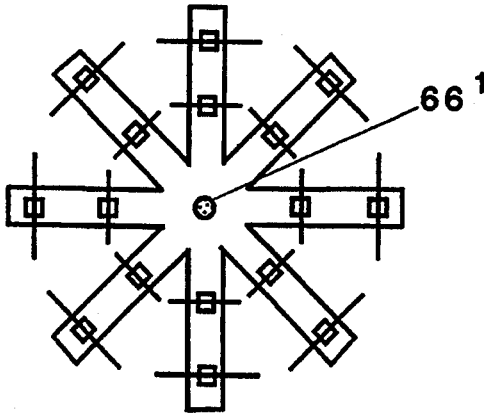

Instead of being in linear array, the oscillator nozzles can be arrayed in a circle as shown in FIG. 6*a* or in transverse crossed array as shown in FIG. 6*b*, which also includes a plot flame 66. Moreover, while it is preferred that the fluidic oscillators be of the same type, there may be cases where the oscillators in one area issue a sweeping jet and in other areas a sweeping sheet is issued.

While there has been described and illustrated specific embodiments of the invention, it will be clear that various variations of the details of construction which are specifically illustrated and described may be resorted to without departing from the true spirit and scope of the invention as defined in the appended claims.

What is claimed is:

1. In a system for heating objects having a supply of fluid fuel under pressure which is to be stoichiometrically mixed to achieve a combustible mixture, fluid fuel flow line connected to said fluid fuel under pressure, a manual control valve in said fluid fuel flow line, a burner means for mixing air with said fluid fuel to achieve said combustible mixture, characterized by said burner means includes a fluidic oscillator for forming a jet of said fluid fuel and oscillating said jet of fluid fuel in ambient air downstream of said fluidic oscillator to mix air with said fuel and achieve said combustible mixture a distance spaced from any physical structure of said torch whereby a flame front of burning combustible mixture has a broad shape and is spaced a distance from said fluidic oscillator which is determined by the sweep angle, wave pattern and frequency of said fluidic oscillator.

2. A burner nozzle system for mixing fuel with air to attain a combustible fuel-air-mixture, comprising, a nozzle for creating a jet of said fuel and means for oscillating said jet of fuel in the ambient air downstream of said means for oscillating to achieve said combustible fuel-air-mixture at a distance spaced downstream from said means for oscillating to maintain said means for oscillating cool.

3. The burner system defined in claim 2 wherein said means for oscillating said jet of fuel is a no-moving part fluidic oscillator.

4. The burner system defined in claim 3 wherein said fluidic oscillator is of the type having an oscillation chamber with single outlet and fuel exiting said single outlet seals said oscillation chamber from ambient conditions.

5. The burner system defined in claim 3 including means for varying the frequency of oscillation of said fluidic oscillator.

6. The burner system defined in claim 3 wherein said fluidic oscillator is of the type which depends on the formation and movement of vortices of said fuel to sustain oscillation.

7. The burner system defined in claim 3 wherein said fluidic oscillator is of the type which entrains ambient air to premix said fuel with entrained air.

8. The burner system defined in any one of claims 2–7 wherein the rate of oscillation of said jet is 1 to 3 kHz.

9. The burner system defined in any one of claims 2–7 wherein said means for oscillating is a fluidic oscillator and said jet is in the form of a sheet of fluid fuel.

10. The method defined in claim 9 including varying the rate of said oscillations.

11. The method defined in claim 9 wherein said predetermined sweep rate is 1 to 3 kHz.

12. The invention defined in claim 1 wherein there are a plurality of said fluidic oscillators.

13. The invention defined in claim 12 wherein said plurality of fluidic oscillators are arrayed in a predetermined pattern.

14. The invention defined in claim 2 wherein said means for oscillating includes a plurality of fluidic oscillators and means for mounting said plurality of fluidic oscillators in a predetermined pattern.

15. A method of maintaining a burner nozzle cool during operation comprising creating a jet of fuel and oscillating said jet of fuel in ambient air downstream of said burner nozzle through a sweep angle $\alpha$ at a predetermined sweep rate to mix the fuel with said ambient air and achieve a combustible mixture at a flame front a distance spaced downstream from said torch nozzle to maintain said burner nozzle cool.

16. In a system for heating objects having a supply of fluid fuel under pressure which is to be stoichiometrically mixed to achieve a combustible mixture, fluid fuel flow line connected to said fluid fuel under pressure, control valve in said fluid fuel flow line, a burner means for mixing air with said fluid fuel to achieve said combustible mixture, characterized by said burner means includes a fluidic oscillator for forming a sheet of said fluid fuel and oscillating said sheet of fluid fuel in ambient air downstream of said fluidic oscillator to mix air with said fuel and achieve said combustible mixture a distance spaced from any physical structure of said torch whereby a flame front of burning combustible mixture has a broad shape and is spaced a distance from said fluidic oscillator which is determined by the sweep angle, wave pattern and frequency of said fluidic oscillator.

17. The system defined in claim 16 including a plurality of said fluidic oscillators and means for mounting said plurality of fluidic oscillators in a patterned array.

* * * * *